US005265022A

United States Patent [19]

Chonan et al.

[11] Patent Number: 5,265,022

[45] Date of Patent: Nov. 23, 1993

[54] ENGINE PROTECTING SYSTEM

[75] Inventors: Mitsugu Chonan, Tokyo; Yoshiki Yuzuriha, Isesaki, both of Japan

[73] Assignees: Fuji Heavy Industries Ltd., Tokyo; Japan Electronic Control Systems Co., Ltd., Isesaki, both of Japan

[21] Appl. No.: 15,045

[22] Filed: Feb. 8, 1993

Related U.S. Application Data

[63] Continuation of Ser. No. 603,955, Oct. 26, 1990, abandoned.

[51] Int. Cl.[5] ..... F02D 41/22

[52] U.S. Cl. ..... 364/431.04; 123/198 D; 123/478; 340/661; 364/424.03

[58] Field of Search ..... 364/431.03, 431.04, 364/431.05, 431.09, 424.05, 431.11, 424.03, 424.04; 123/445, 472, 478, 479, 480, 488, 198 D, 490, 491, 425; 340/428, 438, 439, 660, 661, 663; 307/10.6, 10.7

[56] References Cited

U.S. PATENT DOCUMENTS

| | | | |
|---|---|---|---|
| 4,244,050 | 1/1981 | Weber et al. | 364/431.11 X |
| 4,362,133 | 12/1982 | Malik | 123/179.23 |
| 4,364,343 | 12/1982 | Malik | 123/179.4 |
| 4,491,112 | 1/1985 | Kanegae et al. | 123/479 |
| 4,492,912 | 1/1985 | Nowakowski | 320/6 |
| 4,563,991 | 1/1986 | Akatsuka et al. | 123/440 |
| 4,603,669 | 8/1986 | Takemoto et al. | 123/357 |
| 4,653,445 | 3/1987 | Book et al. | 123/198 DC |
| 4,683,859 | 8/1987 | Tamura et al. | 123/491 |
| 4,788,486 | 11/1988 | Mashino et al. | 320/17 |
| 4,903,657 | 2/1990 | Miyazaki et al. | 123/339 |
| 4,926,331 | 5/1990 | Windle et al. | 364/424.04 |
| 4,939,502 | 7/1990 | Ito et al. | 340/438 |
| 4,992,670 | 2/1991 | Pastor | 307/10.3 |
| 5,003,951 | 4/1991 | Komuraski | 123/425 |
| 5,072,703 | 12/1991 | Sutton | 123/179.4 |

FOREIGN PATENT DOCUMENTS 63-255543 10/1988 Japan .

*Primary Examiner*—Thomas G. Black
*Assistant Examiner*—Collin W. Park
*Attorney, Agent, or Firm*—Foley & Lardner

[57] ABSTRACT

A system for protecting an engine equipped with an electronically controlled fuel injection apparatus, in which a battery voltage is detected. When the detected battery voltage is smaller than a predetermined reference value, performance of the engine is degraded, and when the detected battery voltage is smaller than a reference value, that is smaller than the predetermined value, the engine is stopped.

9 Claims, 6 Drawing Sheets

ENGINE PROTECTING SYSTEM

This application is a continuation of application Ser. No. 07/603,955, filed Oct. 26, 1990, now abandoned.

BACKGROUND OF THE INVENTION

1. Field of the Invention

The present invention relates to a protecting system for an engine equipped with an electronically controlled fuel injection apparatus. More particularly, the present invention relates to a system for protecting an engine by preventing occurrence of an abnormal revolution such as an overrun at abnormal reduction of a battery voltage caused, for example, by a trouble in a charging system of a battery.

2. Description of the Related Art

As the 2-cycle engine for a two-wheeled vehicle or a snow mobile, there has been adopted an engine having a fuel supply system where injection of a fuel is electronically controlled by using a fuel injection valve (see, for example, Japanese Unexamined Patent Publication No. 63-255543). For example, there can be a fuel supply system in which a fuel injection valve is arranged in an intake manifold zone of each cylinder, and injection is simultaneously effected in all of the cylinders.

In a two-wheeled vehicle having an electronically controlled fuel injection system, when the voltage is abnormally reduced because of the trouble in a charging system of a battery or the like, the electronically controlled fuel injection apparatus is operated for a while by the voltage of the battery, however, if the voltage is gradually reduced and becomes lower than the rated voltage of a control unit, there is a possibility that an abnormal operation in the fuel injection apparatus will occur causing an abnormal engine state, as for example, an overrun of the engine.

SUMMARY OF THE INVENTION

The present invention overcomes the above disadvantage of the conventional technique. A primary object of the present invention is to protect an engine by preventing occurrence of an abnormal state, such as an overrun of the engine, by informing a driver of abnormal reduction of the battery voltage caused by trouble in the charging system of the battery or the like.

Another object of the present invention is to assuredly inform a driver when an abnormal reduction of the battery voltage occurs.

If a mere display device alone is used as the means for informing the driver of the battery voltage reduction, as for example, when a snow mobile or the like is running on snow, it is apprehended that the display device will be frozen or will not be seen because of the snow. Accordingly, the ability to assuredly provide the information is important.

Still another object of the present invention is to protect an engine during the occurrence of an abnormal reduction of the battery voltage by informing a driver assuredly of this abnormal reduction and simultaneously, controlling the revolution speed of the engine.

A further object of the present invention is to protect an engine during occurrence of an abnormal reduction of the battery voltage by informing a driver of this abnormal reduction and forcibly stopping the engine.

In accordance with the present invention, there is provided a protecting system for an engine equipped with an electronically controlled fuel injection apparatus, which comprises, as shown in FIG. 1A, means for detecting a battery voltage value, judging means for comparing a detection value signal outputted from the battery voltage value-detecting means with a preliminarily set reference value signal of the battery voltage and judging whether or not the detection value is smaller than the reference value, and control means for performing the control of degrading the operability of the engine when it is judged by the judging means that the detection value is smaller than the reference value.

As the control means for degrading the operability of the engine, there can be adopted means for controlling the electronically controlled fuel injection apparatus such that excessive increases or excessive decreases of the fuel injection quantity is accomplished according to the degree of degradation of the operability of the engine, thereby making the air-fuel ratio too rich or too lean.

Furthermore, the control means can be a means for excessively delaying or advancing the ignition timing of the engine according to the degree of degradation of the operability of the engine.

Since the operability of the engine is degraded by the control means, a driver will feel this degradation while driving the vehicle, and the driver will know a problem exists and can take appropriate action to correct the problem.

One embodiment for degrading the operability of the engine during the occurrence of trouble with the battery, includes the method in which the engine is forcibly stopped as shown in FIG. 1B. In this case, the engine-stopping means includes a means for stopping injection of a fuel to the engine or a means for stopping ignition on the engine.

According to the present invention, in the case where the battery is abnormally reduced, a driver is informed of the abnormal reduction of the battery voltage by the forcible stopping of the engine.

More specifically, in accordance with the present invention, there is provided a protecting system for an engine equipped with an electronically controlled fuel injection apparatus, which comprises, as shown in FIG. 1C, means for detecting a battery voltage value, first judging means for comparing a detection value signal outputted from the battery voltage value-detecting means with a preliminary set first reference value signal of the battery voltage and judging whether or not the detection value is smaller than the reference value, second judging means for comparing the detection value signal outputted from the battery voltage value-detecting means with a second reference value signal smaller than the first reference value signal and judging whether or not the detection value is smaller than the second reference value, first control means for performing the control of degrading the operability of the engine when it is judged by the first judging means that the detection value is smaller than the first reference value, and second control means for performing the control of stopping then engine when it is judged by the second judging means that the detection value is smaller than the second reference value.

If this engine protecting system is adopted, the operability of the engine is first degraded upon occurrence of trouble in the battery driving system, and a driver can feel the degradation while driving the vehicle such that the driver is alerted of the trouble in the battery system and appropriately cope with the trouble. Then, by forcibly stopping the engine, the occurrence of an engine overrun or other problems with the engine that can be caused by an abnormal operation of a control unit, can be prevented.

The present invention will now be described in detail with reference to embodiments illustrated in the accompanying drawings. However, the present invention is not limited by these embodiments and various modifications can be freely made within the scope defined by the claims.

DETAILED DESCRIPTION OF THE PREFERRED EMBODIMENTS

Figure 1A:
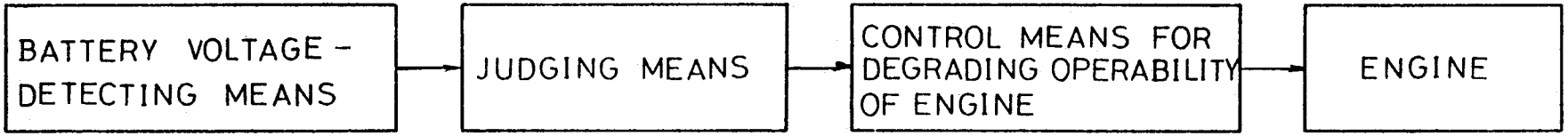
FIGS. 1A, 1B and 1C are functional block diagrams showing the structure of the present invention.
Figure 1B:
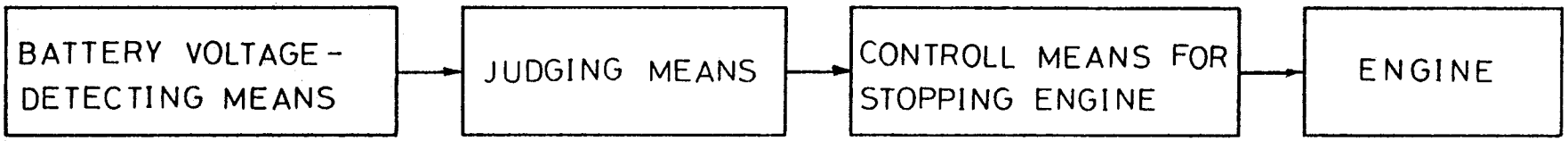
Figure 1C:
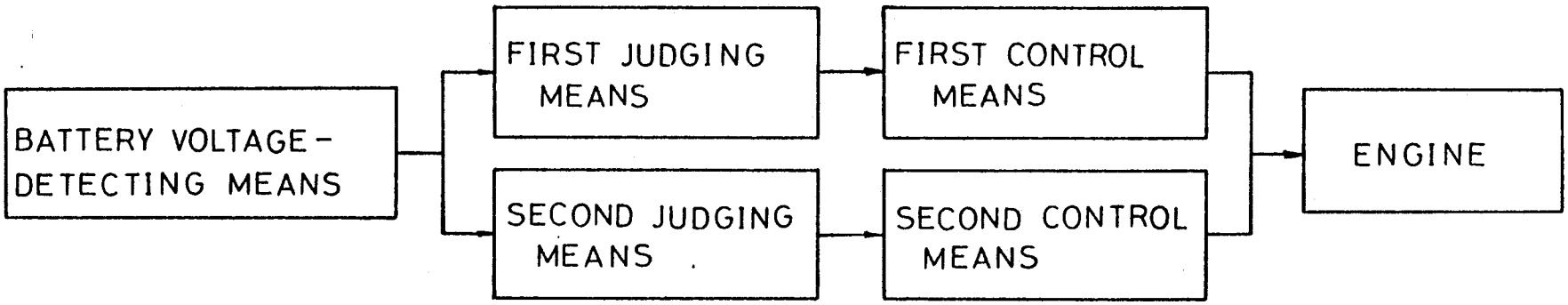
Figure 2:
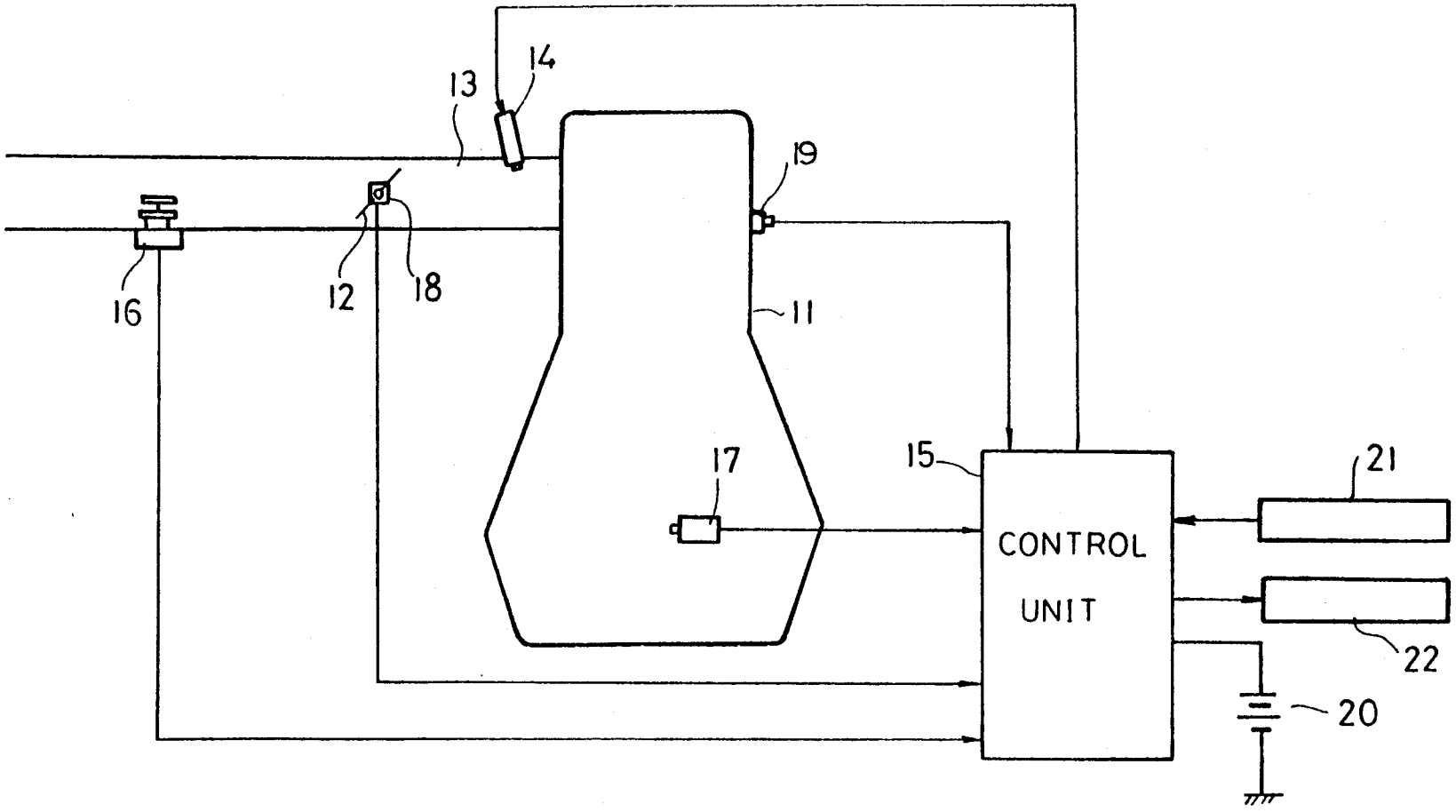
FIG. 2 is a system diagram illustrating one embodiment of the present invention.

FIG. 2 is a diagram of a control system of a twocycle engine equipped with an electronically controlled fuel injection system as an example of the engine of the present invention. Air is sucked into this engine through an intake manifold 13 through an air cleaner, not shown in the drawings, via a throttle valve 12 operating with an accelerator pedal.

Fuel injection valves 14 for respective engine cylinders, are arranged at a branch portion of the intake manifold 13. Each fuel injection valve 14 is an electromagnetic fuel injection valve which is opened by application of electricity to a solenoid, and is closed by stopping the application of electricity to the solenoid. Namely, when the solenoid is actuated by a driving pulse signal from a control unit 15, the valve 14 is opened, and while the valve 14 is opened, a fuel, fed under pressure from a fuel pump and having a pressure adjusted to a predetermined level by a pressure regulator, is injected and supplied to the engine.

Output signals from various sensors are inputted into the control unit 15, and an operation of input data is performed by a microcomputer built in the control unit 15 to determine a fuel injection quantity (injection time) Ti and an injection timing, and a driving pulse signal is outputted to the fuel injection valve 14 according to the determined fuel injection quantity and injection timing. The control unit 15 outputs an operation control signal to an igniting apparatus 22 to control the ignition timing. The above-mentioned microcomputer comprises a central processing unit, an input-output processing unit, a memory and the like.

These sensors include an air flow meter 16 for outputting a signal corresponding to an intake air flow quantity Q and an engine crank angle sensor 17 built in a distributor (not shown in the drawings) to output a reference signal at every 120°. The revolution speed of the engine can be detected by measuring the frequency of this reference signal.

A throttle sensor 18, of the potentiometer type, is disposed in the throttle valve 12 to output a signal corresponding to the opening degree $\alpha$ of the throttle valve 12. Furthermore, a water temperature sensor 19 is arranged in a water jacket of the engine 11 to output a signal corresponding to a cooling water temperature Tw. A voltage of a battery 20, as the operation power source or for detection of a power source voltage VB, is applied to the control unit 15.

Figure 3:
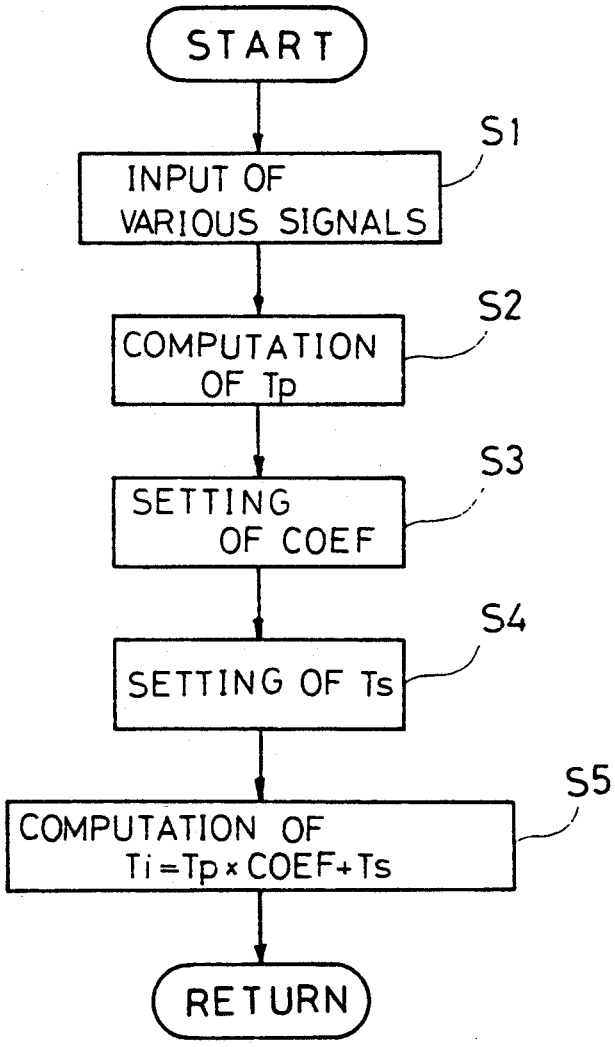
FIG. 3 is a flow chart showing the contents of the fuel injection control in one embodiment of the present invention.

The routine of setting the injection of the fuel by the microcomputer in the control unit 15 will now be described in detail with reference to the flow chart of FIG. 3.

At step 1 (referred to as "S1" in the drawings; subsequent steps are similarly indicated), information concerning the driving state of the engine as detected by the sensors are inputted in the microcomputer.

At step 2, the basic fuel injection quantity Tp ($=K\times Q/N$: K is a constant) is computed based on the sucked air flow quantity Q and the engine revolution number N.

At step 3, various correction coefficients COEF are set by the cooling water temperature Tw representing the engine temperature and the like.

At step 4, a voltage correction value Ts is set according to the voltage VB of the battery 20. This voltage correction value Ts is to correct the change of the effective opening time of the fuel injection valve 14 caused by the change of the battery voltage VB.

At step 5, the actual fuel injection quantity is computed from obtained Tp, COEF and Ts according to the following equation:

$$Ti = Tp \times COEF + Ts$$

In the control unit 15, there are disposed first judging means for comparing a detection value signal outputted from the battery voltage-detecting means 21 for detecting the battery voltage value with a preliminary set first reference value signal of the battery voltage, and judging whether or not the detection value is smaller than the first reference value, second judging means for comparing the detection value signal outputted from the battery voltage value-detecting means with a second reference value signal smaller than the first reference value signal and judging whether or not the detection value is smaller than the second reference value, first control means for controllably degrading the operability of the engine when it is judged that the detection value is smaller than the first reference value, and second control means for stopping the engine when it is judged that the detection value is smaller than the second reference value.

The operation of the respective means will now be described in detail with reference to the flow chart of FIG. 4.

At step 11, the battery voltage VB is detected, and the routine goes into step 12 where the detected voltage VB is averaged. Namely, the voltage detection data are rounded by the average weighting or the like. At step 13, the averaged value (VB) of the battery voltage is compared with the first reference value (for example, 8 V) and it is judged whether or not the averaged value is smaller than the reference value. When the averaged value is smaller than the first reference value, the routine goes into step 14, and when the averaged value is not smaller than the first reference value, the routine returns. At step 14, the controllable degradation of the operability of the engine, as for example, by increasing the fuel injection quantity Ti, is performed. At step 15, the averaged value (VB) of the battery voltage is compared with the second reference value (for example, 7 V), and it is judged whether or not the averaged value is smaller than the reference value. When the averaged value is smaller than the second reference value, the routine goes into step 16, and when the averaged value is not smaller than the second reference value, the routine returns. At step 16, the stopping of the engine occurs, as for example, when the injection of fuel into the engine is stopped.

Figure 4:
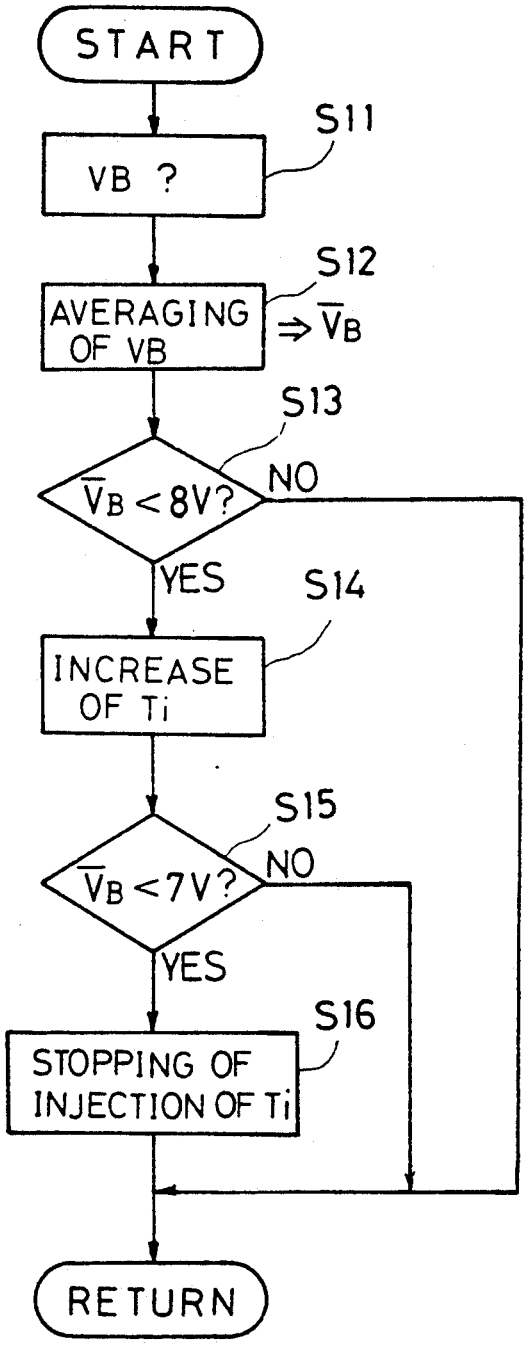
FIG. 4 is a flow chart showing the contents of the control concerning injection among the contents of the engine control.

In the embodiment shown in FIG. 4, steps 11 and 12 correspond to the battery voltage-detecting means, steps 13 and 15 correspond to the judging means, and steps 14 and 16 correspond to the control means for performing the control of degrading the operability of the engine and the control of stopping the engine.

When the above-mentioned structure is adopted, as in the case where the battery voltage is abnormally reduced by trouble occurring in the charging system of the battery, the excessive increase of the fuel injection quantity creates an excessive air-fuel mixing ratio which degrades the combustion state and reduces the output of the engine, such that the operability of the engine is degraded and a driver is quickly informed of the occurrence of the trouble. Finally, when the injection of the fuel is completely stopped and, as the result, the occurrence of an abnormal state of the engine such as an engine overrun, can be prevented and the engine correspondingly can be protected.

In the above-mentioned embodiment, for example, by controlling the excessive increased fuel injection quantity (Ti) the degree of degradation of the operability of the engine can be controlled. Furthermore, while the control of stopping the fuel injection is performed as the mechanism for stopping the engine, other methods can be adopted. For example, the following controls can be used to control the degree of degradation of the operability of the engine.

(a) The fuel injection quantity is excessively decreased.

(b) Excessive increase of the fuel injection quantity and excessive decrease of the fuel injection quantity are carried out alternately.

(c) The ignition timing is excessively delayed.

(d) Excessive advance of the ignition timing and excessive delay of the ignition timing are carried out alternately.

(e) At a revolution speed exceeding a certain level, the air-fuel ratio is made too rich, or the fuel injection is cut so that the revolution speed does not exceed the certain level.

Figure 5:
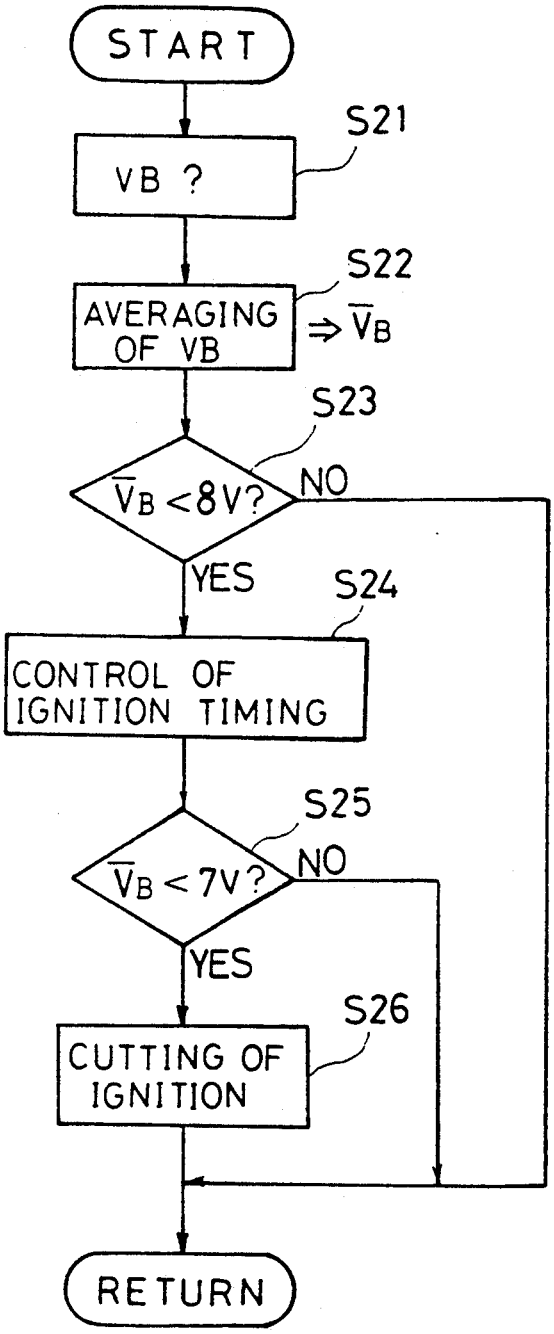
FIG. 5 is a flow chart showing the contents of the control concerning ignition among the contents of the engine control.

The contents of the controls for excessively delaying or advancing the ignition timing and for cutting the ignition will now be described with reference to the flow chart of FIG. 5.

In this flow chart, steps 21 through 23 and step 25 are the same as steps 11 through 13 and 15 in FIG. 4, respectively. At step 24, excessive delay or excessive advance of the ignition timing is performed, and cutting of the ignition is performed at step 26.

In combination with the above-mentioned control method, there can be adopted a method in which indication of a trouble, such as abnormal reduction of the battery voltage, is accomplished by a lamp or an alarm.

Furthermore, the function of controlling the degradation of the operability of the engine, and the function of stopping the engine can be independently disposed.

Figure 6:
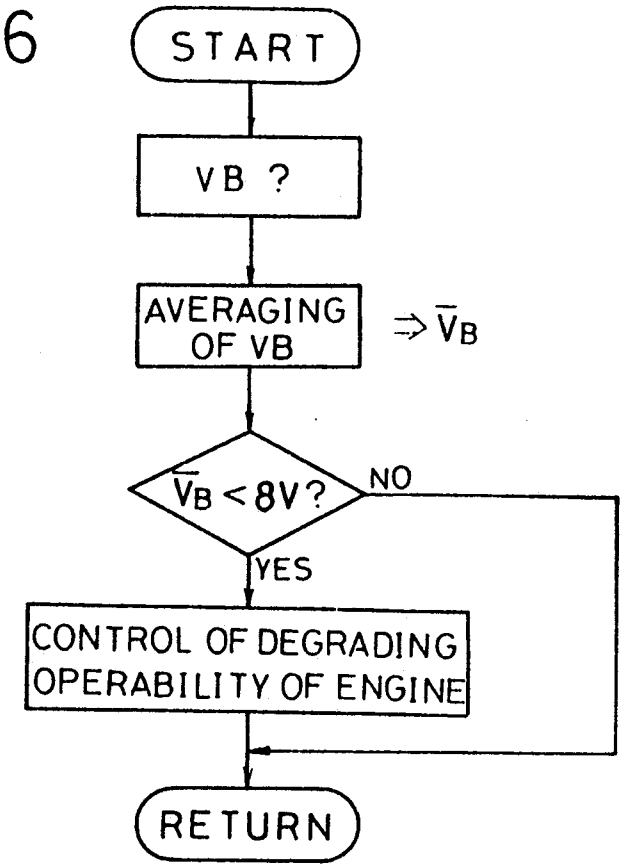
FIG. 6 is a flow chart showing the contents of the control of degrading the operability of the engine among the contents of the engine control.

The contents of the control by an apparatus equipped only with the function of controlling the degradation of the operability of the engine are illustrated in the flow chart of FIG. 6.

Figure 7:
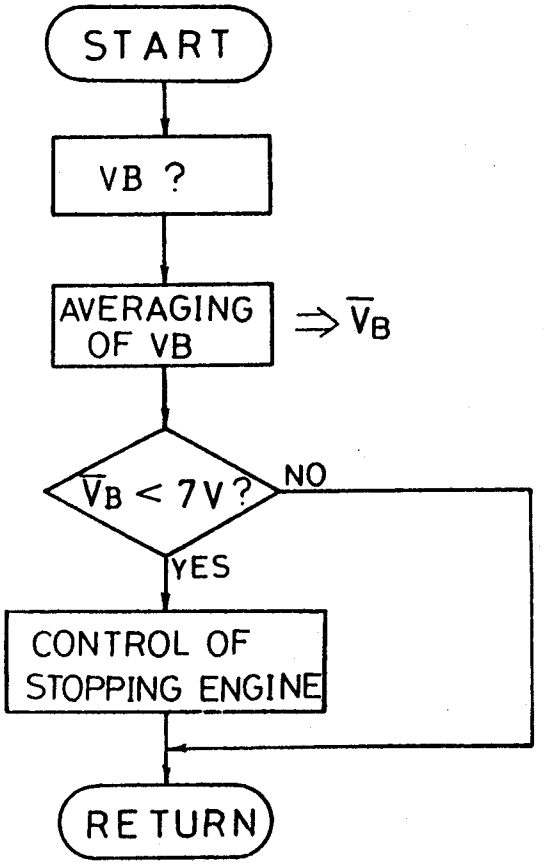
FIG. 7 is a flow chart showing the contents of the control of stopping the engine among the contents of the engine control.

The contents of the control by an apparatus equipped only with the function of stopping the engine are illustrated in the flow chart of FIG. 7.

We claim:

1. A protecting system for an engine having a battery which generates a battery voltage, battery voltage detecting means responsive to said battery voltage for producing a voltage signal, and an electronically controlled fuel injection apparatus for injecting a fuel injection quantity into an intake manifold of said engine, comprising:

(A) first judging means responsive to said voltage signal for comparing said voltage signal with a predetermined value and for outputting a first signal when said voltage signal is lower than said predetermined value;

(B) second judging means responsive to said voltage signal for comparing said voltage signal with a reference value and for outputting a second signal when said voltage signal is lower than said reference value, wherein said reference value is smaller than said predetermined value;

(C) first control means responsive to said first signal for for detrimentally changing an operating condition of said engine such that said engine does not function properly thereby warning that a malfunction of said engine has occurred; and (D) second control means responsive to said second signal for immediately stopping said engine so as to prevent said engine from being damaged.

2. An engine protecting system as set forth in claim 1, wherein the battery voltage detecting means includes means for computing an averaged value of the battery voltage and for outputting the averaged value.

3. An engine protecting system as set forth in claim 1, wherein the first control means includes means for controlling the electronically controlled fuel injection apparatus such that at least one of excessive increase and excessive decrease of the fuel injection quantity is performed.

4. An engine protecting system as set forth in claim 1, wherein the first control means includes means for performing at least one of excessive delay and excessive advance of an ignition timing of the engine.

5. An engine protecting system as set forth in claim 1, wherein the first control means includes means for rendering an air-fuel mixing ratio too rich by excessively increasing the fuel injection quantity in response to said first signal.

6. An engine protecting system as set forth in claim 1, wherein the first control means includes means for stopping injection of said fuel injection quantity into the engine in response to said first signal.

7. An engine protecting system as set forth in claim 1, wherein the first control means includes means for stopping an engine in response to said first signal.

8. An engine protecting system as set forth in claim 1, wherein the second control means includes means for stopping injection of said fuel injection quantity by controlling the electronically controlled fuel injection apparatus.

9. An engine protecting system as set forth in claim 1, wherein the second control means includes means for stopping an engine ignition.

* * * * *